US005478631A

United States Patent [19]

Kawano et al.

[11] Patent Number: 5,478,631

[45] Date of Patent: Dec. 26, 1995

[54] INK JET RECORDING SHEET

[75] Inventors: Kazuhiko Kawano; Shunichiro Mukoyoshi; Seigoro Fujita, all of Amagasaki, Japan

[73] Assignee: Kanzaki Paper Mfg. Co., Ltd., Tokyo, Japan

[21] Appl. No.: 117,223

[22] Filed: Sep. 3, 1993

[30] Foreign Application Priority Data

Sep. 9, 1992 [JP] Japan ..... 4-240828
Nov. 25, 1992 [JP] Japan ..... 4-315037

[51] Int. Cl.[6] ..... B41M 5/00

[52] U.S. Cl. ..... 428/212; 428/195; 428/211; 428/323; 428/331; 428/500; 428/537.5

[58] Field of Search ..... 428/211, 219, 428/511, 537.1, 537.5, 195, 212, 323, 331, 500

[56] References Cited

U.S. PATENT DOCUMENTS 4,778,711 10/1988 Hosomura et al. ..... 428/211
4,954,395 9/1990 Hasegawa et al. ..... 428/195

*Primary Examiner*—B. Hamilton Hess
*Attorney, Agent, or Firm*—Killworth, Gottman, Hagan & Schaeff

[57] ABSTRACT

An ink jet recording sheet which absorbs water-base ink well, gives high-grade images, and ensures excellent water resistance of printed images. The ink jet recording sheet comprises a substrate and an ink receptive layer disposed on the substrate, the ink receptive layer containing a pigment and a binder as its main components, the improvement comprising the ink receptive layer being an aqueous composition containing a pigment and an ampho-ion latex as its main components.

8 Claims, 1 Drawing Sheet

INK JET RECORDING SHEET

FIELD OF THE INVENTION

The present invention relates to an ink jet recording sheet. More particularly, the invention relates to an ink jet recording sheet which absorbs water-base ink well, gives high-grade images, and ensures excellent water resistance of printed images.

DESCRIPTION OF THE PRIOR ART

Recently, ink jet recording systems have been widely used in various facsimiles and printers because in these systems little noise is made, high-speed recording being possible, full-color recording being easy, hard copies being easy to obtain, and the cost for recording being low.

Conventional ink jet recording sheets include normal papers; papers which have an ink receptive layer comprising various pigments and binders so that ink is quickly absorbed into a substrate of paper, etc. and clear ink dots are formed in order to give bright images; and recording papers containing porous pigments.

For example, Japanese Patent Laid-Open Publication No. Sho 57-82085 discloses an ink receptive layer comprising organic and inorganic pigments and water-soluble high polymer binders. Japanese Patent Laid-Open Publication No. Sho 62-268682 discloses an ink receptive layer containing fine-grained silica and, as a binder, polyvinyl alcohol copolymer having a silanol group.

With the progress of high-speed and full-color recording realized by the increase of the performance of ink 3et recording systems, ink jet recording sheets are required to have better properties. To obtain high-grade images, ink jet recording sheets are required to have the following properties for example:

(1) The papers absorb ink quickly and have a large absorptive capacity.

(2) Ink dots in recorded images are not too large.

(3) When ink dots overlap with each other, an ink dot placed later does not flow out into an ink dot placed earlier.

(4) Ink develops color well.

(5) The ink receptive layer has a large surface strength.

(6) The substrate is resistant to water. Ink does not make cockling or curling in the substrate.

(7) The ink receptive layer is resistant to water after image recording.

(8) The ink receptive layer does not change with the lapse of time.

Attempts made to satisfy such requirements include using porous pigments or water-soluble high polymer compounds having excellent ink absorption as a component of the ink receptive layer of an ink jet recording sheet, using a latex for improving the water resistance of the ink receptive layer, and using a water-resistant synthetic paper or plastic film as a substrate.

However, if a paper is used as a substrate or only a water-soluble high polymer compound is used as a binder of an ink receptive layer, then the ink jet recording sheet will have the disadvantages that water resistance is weak, recorded images have bleeding or color fading, and paper troubles such as cockling and curling are liable to occur. If a synthetic paper or a plastic film is used as a substrate or a Latex is used as a binder, then the ink jet recording sheet will have the disadvantages that the adhesion between the ink receptive layer and the substrate is weak and ink is not dried or absorbed well.

OBJECTS AND SUMMARY OF THE INVENTION

It is an object of the invention to provide an ink jet recording paper which absorbs ink quickly.

It is another object of the invention to provide an ink jet recording paper which ensures ink dots having little bleeding and sharp shapes.

It is a further object of the invention to provide a full-color ink jet recording paper which gives high-grade printed images having excellent color reproduction.

It is a still further object of the invention to provide a full-color ink jet recording paper which has an ink receptive layer having excellent water resistance and moisture resistance.

These and other objects have been attained by an ink jet recording sheet comprising a substrate and an ink receptive layer disposed on said substrate, said ink receptive layer containing a pigment and a binder as its main components, the improvement comprising said ink receptive layer being an aqueous composition containing a pigment and an amphoteric latex as its main components.

Generally speaking, the resolution of the recorded images of an ink jet recording sheet depends upon the amount of ink absorption. If the ink absorption is made too high, the recorded image density will be reduced, the brightness and reproduction of colors being lost and resolution being affected. If the ink absorption is made too low, the image density will be higher but there will be disadvantages that the image qualities are reduced because of too thick printed letters, bleeding and uneven shading and further the ink drying time becomes too long.

As a result of earnest studies to solve the abovementioned problems of the conventional ink jet recording sheets, the inventors have found that by forming an ink receptive layer comprising a specific aqueous composition on a substrate it is possible to obtain an ink jet recording sheet having excellent ink absorption, color reproduction of ink , surface strength and water resistance as well as giving high-grade images having sharp ink dots.

DETAILED DESCRIPTION

Figure 1:
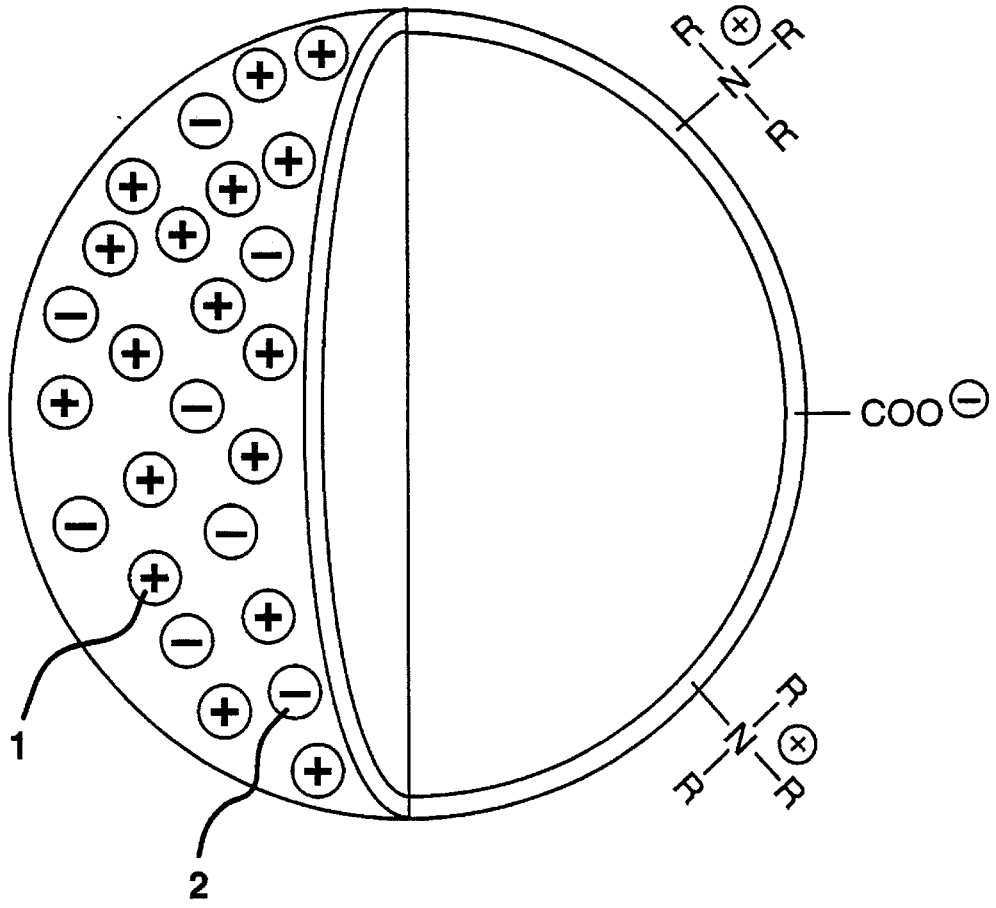
FIG. 1 is a schematic illustration of an ampho-ion latex contained in an ink receptive layer of an ink jet recording sheet according to the present invention.

An ink jet recording sheet according to the present invention is characterized by having an ink receptive layer on a substrate, said ink receptive layer being an aqueous composition containing a pigment and an amphoteric latex as its main components.

The amphoteric latex used in the present invention has a core shell complex construction as shown in FIG. 1 and basic properties as shown in Table 1. The amphoteric latex has an amphoteric functional group on the surface of the same particle, quaternary alkylamine groups 1 (cationic) being denser than carboxyl groups 2 (anionic). The latex has a particle diameter of about 0.2 μm, forming a film, being mechanically stable and having a cationic colloid equivalent value on the average.

The amphoteric latex is obtained as follows:

A carboxylated synthetic rubber latex or synthetic resin emulsion is used as a seed latex. The seed latex is neutralized so as to have a pH value of above 6. A monomer shown by general formula [1] or a mixture of said monomer and an ethylene unsaturated monomer copolymerizable with said monomer is added to the neutralized latex, tile equivalent value of tile added monomer(s) being larger than the colloid equivalent value (absolute value) of the seed latex. A polymer is obtained by polymerizing the seed latex and the added monomer(s) by means of a radical polimerization initiator. Now, the amphoteric latex used in the present invention is obtained by neutralizing the polymer by means of an acid or a salt, or by turning said polymer into a quaternary ammonium salt by means of a general alkylating agent which may be, for example, alkyl halogenide, dimethyl sulfate or diethyl sulfate.

The amphoteric latex is a polymer emulsion in which a cationic property is densely given to tile emulsion particle surface.

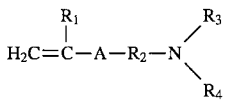

General Formula [1]

(in the formula,

"$R_1$" represents H or $CH_3$,

"$R_2$" represents an alkylene group having 2 to 5 carbons,

"$R_3$" and "$R_4$" represent H or an alkyl group having 1 to 5 carbons, and

"A" represents

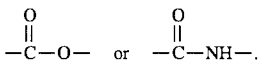

"$R_2$", "$R_3$" and "$R_4$" are selected within a range in which the monomer is not soluble in water or not easily soluble in water.)

Said colloid equivalent value is a value obtained as follows:

95 milliliters of distilled water is put into a beaker and 5 milliliters of 1000 ppm sample solution is added thereto. The mixture is adapted to have a pH value of 4 by means of 1% HCl and agitated for about 1 minute.

Then, 2 to 3 drops of toluidine blue indicator is added thereto and titration is made by means of N/400 PVSK (polyvinyl potassium sulfate). The titration speed is 2 milliliters per minute. The color of the liquid changes from blue into red. The time when the red color has been maintained for a period of above 10 seconds is deemed to be the end point of the reaction. The colloidal equivalent value is calculated as follows:

$$\text{Colloid equivalent value (meq/g)} = \frac{(\text{sample titration value} - \text{blank titration value}) \times F}{2}$$

("F" is a factor of the sample itself.)

The monomer shown by said general formula [1] is preferably used for the following reasons:

The monomer is not soluble in water or not easily soluble in water. Therefore, cation dissociation during polymerization is controlled and a stable copolymer is easily supplied. Since an amino group is included in the constitutional formula, the generated copolymer can be easily neutralized by an acid or a salt or turned into a quaternary ammonium salt by means of the above-mentioned alkylating agent. Thereby, a cationic property densely given to the emulsion particle surface.

The monomer shown by said general formula [1] may be any of the following for example: diethyl aminoethyl acrylate, diethyl aminoethyl methacrylate, dipropyl aminoethyl acrylate, dipropyl aminoethyl methacrylate, dibutyl aminoethyl methacrylate, t-butyl aminoethyl (meth)acrylate, diethyl aminopropyl methacrylamide, dipropylaminopropyl acrylamide, dipropyl aminopropyl methacrylamide, dibutyl aminopropyl methacrylamide and dibutyl aminopropyl acrylamide.

Other ethylene unsaturated monomers copolymerizable with the monomer shown by said general formula [1] may be as follows for example: hydrophobic monomers such as acrylic ester, methacrylic ester, acrylonitrile, stylene and vinyl acetate; and cross-linking monomers such as N,N'-methylene bis acrylamide, diaryl phthalate, divinyl benzene, and (poly)ethylene glycol di(meth)acrylate.

The ethylene unsaturated monomer copolymerizable with the monomer of said general formula [1] is usually used in an amount of about 0 to 40 by weight of the monomer of said general formula [1] according to the glass transition temperature and property of the latex.

An aqueous composition comprising the latex has the advantages of being less liable to act as a surface-active agent and to produce foam, having a strong adhesion to inorganic pigments, being stable in a wide pH range, being compatible with cationic polymers and free from solvent shocks, and furthermore having excellent air permeability and better water resistance than that of PVA binders. The above-mentioned amphoteric latex has the advantages that it has good miscibility with various pigments and strong adhesion to pigments, particularly to silica pigments, and the latex is not easily made viscous as compared with conventional binders.

The amphoteric latex used in the present invention displays its characteristic features as in the following when a synthetic resin material having a strong barrier property such as a plastic film and a synthetic paper is used as a substrate: The ink receptive layer matches the substrate better, and as a result strong adhesion is obtained. The ink receptive layer is free from dusting and has improved surface strength and excellent water resistance.

In conventional ink jet recording sheets containing both pigments and binders, water soluble high polymers such as polyvinyl alcohol (PVA), modified PVA, hydroxyethyl cellulose, CMC, other cellulose derivatives, starch and cationic starch have been used as binders. When only such water soluble high polymers are used as binders, surface strength as in the present invention is not obtained and water resistance after printing is inferior.

If only conventional high-molecular latexes of an aqueous emulsion type such as SBR, polyvinyl acetate, acrylic resin, styrene-acrylic copolymer, ethylene-vinyl acetate copolymer, polyvinylbutyral and polyurethane are used as binders, then the ink receptive layer has water resistance, but there are disadvantages that the absorption of water-base ink is deteriorated and the resolution is lowered because of the whitening phenomenon of the ink receptive layer which is attributable to the latexes. If the amphoteric latex is used as a binder of an ink jet recording sheet as in the present invention, the drawback attributable to the latexes is removed and the water resistance and absorption of water-base ink are remarkably improved.

The reason wily such excellent effects are obtained is not necessarily clear but it is supposed to be as in the following:

ink fixing is improved because the amphoteric latex has cationic quaternary alkylamine groups. Furthermore, an electric interaction is caused between latex particles by the action of ampho ions, and resultant fine gaps contribute to the improvement of ink absorption.

In the present invention, the amphoteric latex is used in a range of 5 to 70 parts by weight, preferably 20 to 50 parts by weight, per 100 parts by weight of pigment. If the amount of the amphoteric latex is above 70 parts by weight, ink absorption and image resolution are deteriorated. If the amount of the amphoteric latex is below 5 parts by weight, water resistance and surface strength are lowered.

The pigment used in the present invention may be any one or more of the following conventional pigments used in the field of coated papers: porous pigments such as white carbon, fine-grained calcium silicate, zeolite, magnesium amino silicate, calcined diatomaceous earth, fine-grained magnesium carbonate, fine-grained alumina, and sea chestnut-shaped or spherical coagulated precipitated calcium carbonate comprising coagulated single particles; mineral fillers such as talc, kaolin, clay, delaminated kaolin, ground calcium carbonate, precipitated calcium carbonate, magnesium carbonate, titanium dioxide, aluminium hydroxide, calcium hydroxide, magnesium hydroxide, magnesium silicate, calcium sulfate, sericite, bentonite and smectite; fine-grained organic pigments such as polystyrene resin, urea resin, acrylic resin, melamine resin and benzoguanamine resin; and organic synthetic pigments such as fine-grained hollow particles.

As a result of various studies concerning pigments in the ink receptive layer (aqueous composition), the inventors have found that the use of fine-grained silica as a pigment ensures better effects. Porous pigments have often been used for the ink receptive layer of water-base ink jet recording sheets. The amount of ink absorbed by the porous pigments varies according to their kind, shape, particle diameter, specific surface area, rate of absorption, etc.

Said fine-grained silica used in the present invention is a white porous pigment having a high oil absorptivity and a large specific surface area. Amorphous silica having a secondary particle diameter of below 15 μm gives remarkable effects. Particularly, amorphous silica having a particle diameter of 0.1 to 15 μm and a specific surface area of about 200 $m^2/g$ by the BET method is preferably used. If the particle diameter is above 15 μm, the fixing of water-base ink is deteriorated, the diameter of ink dots being too large, and resolution being inferior. If the particle diameter is below 0.1 μm, the fixing of water-base ink is too slow and the ink drying time is too long.

In the present invention, an aqueous composition comprising the above-mentioned components is formed, as an ink receptive layer, on a substrate. An ink receptive layer containing said amphoteric latex provides an ink jet recording sheet having excellent ink absorption and ink fixing. The substrate is preferably a plastic film or a synthetic paper. The coating amount of the aqueous composition is 5 to 50 $g/m^2$, preferably 10 to 30 $g/m^2$ (dry basis).

As a result of various studies concerning the ink receptive layer (aqueous composition), the inventors have found that the use of both the amphoteric latex and a water-soluble high polymer improves the resolution of the ink receptive layer, because the use of the water-soluble high polymer much increases the capacity of ink absorption, improves the speed of ink absorption and ink drying, and gives better resolution.

In the present invention, any one or more of the following water-soluble high polymers may be used: water-soluble vinyl high polymers such as polyvinyl alcohol, polyvinylpyrrolidone, acetoacetylated polyvinyl alcohol, modified polyvinyl alcohol, polyvinyl methyl ether, polyvinyl pyridium halide, quaternary polyvinylpyrrolidone and polyvinylbutyral; water-soluble as methyl cellulose, ethyl cellulose, methyl ethyl cellulose, hydroxypropyl cellulose and CMC; water-soluble synthetic high polymers such as polyethylene imine and polyethylene oxide; water-soluble acrylic high polymers such as poly(meth)acrylate or a copolymer thereof, (meth)acrylic ester resin and polyacrylimide resin; modified starches such as cationic starch, amphoteric starch, starch ester and oxidized starch; water-soluble natural high polymers such as arabic gum, sodium alginate, gelatin and casein.

Among said water-soluble high polymers, polyvinylpyrrolidone is preferably used in the present invention. An ink receptive layer containing polyvinylpyrrolidone is much superior in the absorption of water-base ink and the drying of ink to an ink receptive layer containing any other water-soluble high polymer. Said polyvinylpyrrolidone is a water-soluble basic polymer having a molecular weight of 100,000 to 1,000,000, preferably 300,000 to 1,000,000. Said polyvinylpyrrolidone is compatible with said amphoteric latex used in the present invention.

The water-soluble high polymer is used always with said amphoteric latex. The amount of the water-soluble high polymer used is preferably in a range of 5 to 70 parts by weight per 100 parts by weight of pigment. If the amount is above 70 parts by weight, the water resistance of the ink receptive layer and recorded images is liable to be affected. If the amount is below 5 parts by weight, the degree of improvement is small.

In addition to said water-soluble polymer, it is possible to use any one or more of the following binders generally used in the field of coated papers as far as the effects of the present invention are not lost: for example conjugate dien copolymer latexes such as SBR latex and methyl methacrylate-butadien copolymer; acrylic polymer latexes such as phenol resin and polymer or copolymer of acrylate and methacrylate ester; vinyl copolymer latexes such as ethylene-vinyl acetate copolymer; modified copolymer latexes comprising any of said copolymer latexes provided with a functional group such as carboxyl group; aqueous thermosetting synthetic resins such as melamine resin and urea resin; and synthetic resins such as polymethyl methacrylate, polyurethane resin, unsaturated polyester resin, vinyl chloride vinyl acetate copolymer, polyvinylbutyral and alkyd resin.

If the ink receptive layer contains a cationic polymer in addition to said water-soluble high polymer, then the cationic polymer serves as a fixing agent of ink and improves the fixing of recorded images and water resistance. The cationic polymer may tie quaternary ammonium salt derivatives of polyethylene imine, acrylic or methacrylic ester copolymer containing a quaternary ammonium group as a copolymer monomer, etc. To be concrete, the cationic polymer may be any of the following for example: poly (diallyl dimethyl ammonium chloride), polyethylene imine hydrochloride, poly (2-acrylo oxyethyl dimethyl sulfonium chloride), poly (N-methyl-4-vinyl pyridium chloride), poly (2-methacryloyloxyethyl-trimethylammonium chloride) and quaternary ammonium salt.

The amount of said cationic polymer is 3 to 50 parts by weight, preferably 10 to 30 parts by weight, per 100 parts by weight of pigment. If the amount of said cationic polymer is below 3 parts by weight, it is difficult to obtain desired effects. If the amount of said cationic polymer is above 50 parts by weight, the effects are in a saturated state and the bleeding and light fastness of recorded images are liable to be affected.

The inventors have made studies in order that said ink receptive layer (aqueous composition) has better ink dot diameter and higher resolution. As a result, the inventors have found that in an ink jet recording sheet comprising a substrate and an ink receptive layer formed on said substrate, said ink receptive layer containing a pigment and a binder as its main components, the resolution of said ink receptive layer can be made much higher if said ink receptive layer comprises the following top layer and bottom layer:

Top layer: an aqueous composition comprising 10 to 35 parts by weight of amphoteric latex and 20 to 70 parts by weight of water-soluble high polymer per 100 parts by weight of pigment, the amount of said amphoteric latex being equal to or smaller than the amount of said water-soluble high polymer Bottom layer: an aqueous composition comprising 40 to 70 parts by weight of amphoteric latex and 5 to 30 parts by weight of water-soluble high polymer per 100 parts by weight of pigment In the present invention, both said amphoteric latex and said water-soluble high polymer arc used. The use of said water-soluble high polymer much increases the absorptive capacity of ink as compared with a case where only said amphoteric latex is used, and improves the resolution of the ink receptive layer. In the present invention, any one or more of the following water-soluble high polymer may be used: water-soluble vinyl high polymer such as polyvinyl alcohol, polyvinylpyrrolidone, acetoacetylated polyvinyl alcohol, denatured polyvinyl alcohol, polyvinyl methyl ether, polyvinyl pyridium halide, quaternary polyvinylpyrrolidone and polyvinylbutyral; water-soluble cellulose derivatives such as methyl cellulose, ethyl cellulose, methyl ethyl cellulose, hydroxypropyl cellulose and CMC; water-soluble synthetic high polymers such as polyethylene imine and polyethylene oxide; water-soluble acrylic high polymers such as Poly-(meth)acrylate or a copolymer thereof, (moth)acrylic ester resin and acrylic amide resin; modified starches such as cationic starch, amphoteric starch, starch ester and oxidized starch; and water-soluble natural high polymers such as arabic gum, sodium alginate, gelatin and casein.

The important characteristic features of the present invention are that an ink receptive layer is formed on a substrate, said ink receptive layer comprises at least a top layer and a bottom layer, said low layer and said bottom layer respectively comprising a certain amount of amphoteric latex and a certain amount of water-soluble high polymer, the amounts of said amphoteric latex and said water-soluble high polymer in said low layer being different from the amounts of said amphoteric latex and said water-soluble high polymer in said bottom layer. Said bottom layer may be further divided into an intermediate layer and a lowest layer, each of which comprises desired components, as far as the effects of the present invention are not lost.

The aqueous composition forming the top layer comprises 10 to 35 parts by weight, preferably 20 to 30 parts by weight, of amphoteric latex and 20 to 70 parts by weight of water-soluble high polymer per 100 parts by weight of pigment, the amount of said water-soluble high polymer being preferably about 2 times the amount of said amphoteric latex. The aqueous composition forming the bottom layer comprises 40 to 70 parts by weight, preferably 45 to 55 parts by weight, of amphoteric latex and 5 to 30 parts by weight of water-soluble high polymer per 100 parts by weight of pigment, the amount of said water-soluble high polymer being preferably about ½ the amount of said amphoteric latex. The ratio between the amphoteric latex and the water-soluble high polymer in the top layer is different from that in the bottom layer for the reasons as in the following:

First, in said top layer, If the amount of the water-soluble high polymer Is larger than the amount of the amphoteric latex, then the surface layer absorbs ink more quickly. As a result, the ink receptive layer has excellent ink drying speed and ink absorption capacity.

Second, in said bottom layer, If the amount of the amphoteric latex is larger than the amount of the water-soluble high polymer, then the adhesion of the ink receptive layer to the substrate is increased. As a result, the surface strength is increased and dusting of the ink receptive layer is prevented.

Third, the combination of said top layer and said bottom layer improves the advantages of both layers and gives an ink receptive layer much better than an ink receptive layer consisting of a single layer. In other words, the combination of said top layer and said bottom layer ensures an ink jet recording sheet having excellent ink absorption, surface strength and water resistance.

In the top layer of the ink receptive layer, if the amount of the amphoteric latex is above 35 parts by weight per 100 parts by weight of pigment or larger than time amount of the water-soluble high polymer, then the ink absorption is unfavorably lowered. If the amount of the amphoteric latex is below 10 parts by weight, then the ink receptive layer has poor surface strength and water resistance.

In the bottom layer of the ink receptive layer, if the amount of the amphoteric latex is above 70 parts by weight per 100 parts by weight of pigment, then no further effects are obtained and this is uneconomical. If the amount of the amphoteric latex is below 40 parts by weight or smaller than the amount of the water-soluble high polymer, then the adhesion of the ink receptive layer to the substrate is unfavorably lowered.

In the top layer of the ink receptive layer, if the amount of the water-soluble high polymer is above 70 parts by weight per 100 parts by weight of pigment, then the desired effects of the present invention are not obtained and the water resistance is poor.

If the amount of the water-soluble high polymer is below 35 parts by weight, then the ink absorption and resolution are unfavorably reduced.

In the bottom layer of the ink receptive layer, if the amount of the water-soluble high polymer is above 30 parts by weight per 100 parts by weight of pigment, then the adhesion of the ink receptive layer to the substrate is unfavorably lowered and the water resistance of the ink receptive layer is poor. If the amount of the water-soluble high polymer is below 5 parts by weight, then the ink absorption is unfavorably reduced.

In addition to the pigment and binder, the aqueous composition may contain, as required, any of the following auxiliary agents for example: thickener, wetting agent, gelling agent, anti-foaming agent, roaming agent, colorant, fluorescent whitening agent, ultraviolet absorbent, antioxidant, quencher, antiseptic agent, antistatic agent, cross-linking agent, dispersing agent, lubricant, plasticizer, pH control agent, flow modifier, hardener and water-resisting agent.

The substrate used in the present invention may be made of any of the following materials for example: cloth; non-woven fabric; wood; metal plate; glass plate; papers such as wood free paper, wood-contained paper, coated paper, art paper and cast coated paper; laminated paper; impregnated paper; non-woven fabric of polyethylene, polypropylene, etc.; resin film of polyethylene, polyethylene terephthalate, polypropylene, diacetate, acrylate, polycarbonate, polyvinyl chloride, polyimide, cellophane, celluloid, etc.; and synthetic paper.

In the present invention, however, the substrate is preferably made of a plastic film or a synthetic paper of polypropylene, etc. which is resistant to water. Such a water-resistant substrate is desirable from a viewpoint of the prevention of cockling and curling after printing as well as the water resistance of printed images. The substrate preferably has a thickness of 10 to 200 μm.

In the present invention, as mentioned above, the ink receptive layer is an aqueous composition provided on the substrate, said ink receptive layer being divided into the top layer and the bottom layer, the composition of said top layer being different from the composition of said bottom layer. Particularly when the substrate is made of a plastic film or a synthetic paper, the desired effects of time present invention are obtained. The top layer of the ink receptive layer has a coating weight, dry basis, of 2 to 25 g/m$^2$, preferably 5 to 15 g/m$^2$. The bottom layer of the ink receptive layer has a coating weight, dry basis, of 2 to 25 g/m$^2$, preferably 5 to 15 g/m$^2$ . The total coating weight, dry basis, of the top layer and the bottom layer is 5 to 50 g/m$^2$, preferably 10 to 30 g/m$^2$ Coating means for forming the ink receptive layer on the substrate may be any of the following conventional coaters used in the field of coated papers, for example: blade coater, air knife coater, roll coater, reverse roll coater, bar coater, curtain coater, die slot coater, gravure coater, Champflex coater, brush coater, two-roll size press coater, metering blade size press coater, gate roll coater, Billblade coater and short-dwell coater.

Either or both of the two sides of the recording sheet may be subjected to aim antistatic treatment and a treatment for giving writability (printability). Also, auxiliary agents such as ultraviolet absorbent and antioxidant may be contained in an arbitrary position of the recording sheet in order that recorded images are preserved better Furthermore, the recording sheet may be finished as an adhesive sheet by providing an adhesive layer and a release liner on the reverse side thereof.

EXAMPLES AND COMPARATIVE EXAMPLES

The present invention will now be described with reference to some examples. It is to be noted that the scope of the invention is not limited to these examples. "Parts" and "%" in the following examples and comparative examples respectively mean "parts by weight" and "% by weight" unless otherwise stated

EXAMPLE 1

Preparation of Aqueous Composition

Coating Composition 1

The following components were mixed with water and agitated so as to obtain an aqueous composition having a solids content of 25%.

- 100 parts precipitated calcium carbonate (trademark: "CALCITE SA", secondary particle diameter: 3.0 μm/made by SHIRAISHI CALCIUM KAISHA, LTD.)
- 46 parts amphoteric latex (trademark: "ACCOSTAR C122"/made by MITSUI CYANAMID, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 1 was applied to a synthetic paper having a thickness of 80 μm (trademark: "YUPO FPG-80"/made by OJI-YUKA SYNTHETIC PAPER CO., LTD.) by means of a bar coater so that the coating weight was 20 g/m$^2$ (solid matter), and then the paper was dried.

EXAMPLE 2

Preparation of Aqueous Composition

Coating Composition 2

The following components were mixed with water and agitated so as to obtain an aqueous composition having a solids content of 25%.

- 50 parts precipitated calcium carbonate (trademark: "CALCITE SA", secondary particle diameter: 3.0 μm/made by SHIRAISHI CALCIUM KAISHA, LTD.)
- 50 parts fine-grained alumina (trademark: "ALUMINA A", secondary particle diameter: 4.8 μm/made by MIZUSAWA INDUSTRIAL CHEMICALS LTD. JAPAN)
- 46 parts amphoteric latex (trademark: "ACCOSTAR C122"/made by MITSUI CYANAMID, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 2 was applied to a synthetic paper having a thickness of 80 μm (trademark: "YUPO FPG-80"/made by OJI-YUKA SYNTHETIC PAPER CO., LTD.) by means of a bar coater so that the coating weight was 20 g/m$^2$ (solid matter), and then the paper was dried.

EXAMPLE 3

Preparation of Aqueous Composition

Coating Composition 3

The following components were mixed with water and agitated so as to obtain an aqueous composition having a solids content of 20%.

- 50 parts precipitated calcium carbonate (trademark: "CALCITE SA", secondary particle diameter: 3.0 μm/made by SHIRAISHI CALCIUM KAISHA, LTD.)
- 50 parts colloidal silica (trademark: "SYLOID", secondary particle diameter: 12 μm/made by FUJI DAVISON CHEMICAL LTD.)
- 46 parts amphoteric latex (trademark: "ACCOSTAR C122"/made by MITSUI CYANAMID, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 3 was applied to a synthetic paper having a thickness of 80 μm (trademark: "YUPO FPG-80"/made by OJI-YUKA SYNTHETIC PAPER CO., LTD.) by means of a bar coater so that the coating weight was 20 g/m$^2$ (solid matter), and then the paper was dried.

EXAMPLE 4

Preparation of Aqueous Composition

Coating Composition 4

The following components were mixed with water and agitated so as to obtain an aqueous composition having a solids content of 20%.

- 100 parts colloidal silica (trademark: "SYLOID", secondary particle diameter: 12 μm/made by FUJI DAVISON CHEMICAL LTD.)
- 46 parts amphoteric latex (trademark: "ACCOSTAR C122"/made by MITSUI CYANAMID, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 4 was applied to a synthetic paper having a thickness of 80 μm (trademark: "YUPO FPG-80"/made by OJI-YUKA SYNTHETIC PAPER CO., LTD.) by means of a bar coater so that the coating weight was 20 g/m$^2$ (solid matter), and then the paper was dried.

EXAMPLE 5

Preparation of Aqueous Composition

Coating Composition 5

The following components were mixed with water and agitated so as to obtain an aqueous composition having a solids content of 10%.

- 50 parts fine-grained silica (trademark: "FINESIL", secondary particle diameter: 3.7 μm, specific surface area by BET method: 280 m$^2$/g/made by TOKUYAMA SODA CO., LTD.)
- 50 parts colloidal silica (trademark: "SYLOID", secondary particle diameter: 12 μm/made by FUJI DAVISON CHEMICAL LTD.)
- 46 parts amphoteric latex (trademark: "ACCOSTAR C122"/made by MITSUI CYANAMID, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 5 was applied to a synthetic paper having a thickness of 80 μm (trademark: "YUPO FPG-80"/made by OJI-YUKA SYNTHETIC PAPER CO., LTD.) by means of a bar coater so that the coating weight was 20 g/m$^2$ (solid matter), and then the paper was dried.

EXAMPLE 6

Preparation of Aqueous Composition

Coating Composition 6

The following components were mixed with water and agitated so as to obtain an aqueous composition having a solids content of 10%.

- 90 parts fine-grained silica (trademark: "FINESIL", secondary particle diameter: 3.7 μm, specific surface area by BET method: 280 m$^2$/g/made by TOKUYAMA SODA CO., LTD.)
- 10 parts colloidal silica (trademark: "SYLOID", secondary particle diameter: 12 μm/made by FUJI DAVISON CHEMICAL LTD.)
- 50 parts amphoteric latex (trademark: "ACCOSTAR C122"/made by MITSUI CYANAMID, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 6 was applied to a synthetic paper having a thickness of 80 μm (trademark: "YUPO FPG-80"/made by OJI-YUKA SYNTHETIC PAPER CO., LTD.) by means of a bar coater so that the coating weight was 20 g/m$^2$ (solid matter), and then the paper was dried.

EXAMPLE 7

An ink jet recording paper was obtained in the same way as in Example 1 except that the coating composition 1 in Example 1 was replaced by a coating composition 7 obtained by adding 23 parts polyvinylpyrrolidone (trademark: "LUVISKOL K-90", molecular weight: 360,000/made by BASF) to said coating composition 1, said coating composition 7 being adapted to have a solids content of 20%.

EXAMPLE 8

An ink jet recording paper was obtained in the same way as in Example 2 except that the coating composition 2 in Example 2 was replaced by a coating composition 8 obtained by adding 23 parts polyvinylpyrrolidone (trademark: "LUVISKOL K-90", molecular weight: 360,000/made by BASF) to said coating composition 2, said coating composition 8 being adapted to have a solids content of 20%.

EXAMPLE 9

An ink jet recording paper was obtained in the same way as in Example 3 except that the coating composition 3 in Example 3 was replaced by a coating composition 9 obtained by adding 23 parts polyvinylpyrrolidone (trademark: "LUVISKOL K-90", molecular weight: 360,000/made by BASF) to said coating composition 3, said coating composition 9 being adapted to have a solids content of 18%.

EXAMPLE 10

An ink jet recording paper was obtained in the same way as in Example 4 except that the coating composition 4 in Example 4 was replaced by a coating composition 10 obtained by adding 23 parts polyvinylpyrrolidone (trademark: "LUVISKOL K-90", molecular weight: 360,000/made by BASF) to said coating composition 4, said coating composition 10 being adapted to have a solids content of 18%.

EXAMPLE 11

An ink jet recording paper was obtained in the same way as in Example 5 except that the coating composition 5 in Example 5 was replaced by a coating composition 11 obtained by adding 23 parts polyvinylpyrrolidone (trademark: "LUVISKOL K-90", molecular weight: 360,000/made by BASF) to said coating composition 5.

EXAMPLE 12

An ink jet recording paper was obtained in the same way as in Example 6 except that the coating composition 6 in Example 6 was replaced by a coating composition 12 obtained by adding 25 parts polyvinylpyrrolidone (trademark: "LUVISKOL K-90", molecular weight: 360,000/made by BASF) to said coating composition 6.

EXAMPLE 13

An ink jet recording paper was obtained in the same way as in Example 7 except that the coating composition 7 in Example 7 was replaced by a coating composition 13 obtained by adding 10 parts cationic polymer (trademark: "SUMIREZ RESIN 1001"/made by SUMITOMO CHEMICAL CO., LTD.) and 20 parts cationic polymer (trademark: "KSR-100K"/made by SANYO CHEMICAL INDUSTRIES, LTD.) to said coating composition 7.

EXAMPLE 14

An ink jet recording paper was obtained in the same way as in Example 8 except that the coating composition 8 in Example 8 was replaced by a coating composition 14 obtained by adding 10 parts cationic polymer (trademark: "SUMIREZ RESIN 1001"/made by SUMITOMO CHEMICAL CO., LTD.) and 20 parts cationic polymer (trademark: "KSR-100K"/made by SANYO CHEMICAL INDUSTRIES, LTD.) to said coating composition 8.

EXAMPLE 15

An ink jet recording paper was obtained in the same way as in Example 9 except that the coating composition 9 in Example 9 was replaced by a coating composition 15 obtained by adding 10 parts cationic polymer (trademark: "SUMIREZ RESIN 1001"/made by SUMITOMO CHEMICAL CO., LTD.) and 20 parts cationic polymer (trademark: "KSR-100K"/made by SANYO CHEMICAL INDUSTRIES, LTD.) to said coating composition 9, said coating composition 15 being adapted to have a solids content of 20%.

EXAMPLE 16

An ink jet recording paper was obtained in the same way as in Example 10 except that the coating composition 10 in Example 10 was replaced by a coating composition 16 obtained by adding 10 parts cationic polymer (trademark: "SUMIREZ RESIN 1001"/made by SUMITOMO CHEMICAL CO., LTD.) and 20 parts cationic polymer (trademark: "KSR-100K"/made by SANYO CHEMICAL INDUSTRIES, LTD.) to said coating composition 10, said coating composition 16 being adapted to have a solids content of 20%.

EXAMPLE 17

An ink jet recording paper was obtained in the same way as in Example 11 except that the coating composition 11 in Example 11 was replaced by a coating composition 17 obtained by adding 10 parts cationic polymer (trademark: "SUMIREZ RESIN 1001"/made by SUMITOMO CHEMICAL CO., LTD.) and 20 parts cationic polymer (trademark: "KSR-100K"/made by SANYO CHEMICAL INDUSTRIES, LTD.) to said coating composition 11, said coating composition 17 being adapted to have a solids content of 20%.

EXAMPLE 18

An ink jet recording paper was obtained in the same way as in Example 12 except that the coating composition 12 in Example 12 was replaced by a coating composition 18 obtained by adding 20 parts cationic polymer (trademark: "SUMIREZ RESIN 1001"/made by SUMITOMO CHEMICAL CO., LTD.) to said coating composition 12, said coating composition 18 being adapted to have a solids content of 20%.

EXAMPLE 19

Preparation of Aqueous Composition

Coating Composition 19

The following components were mixed with water and agitated so as to obtain an aqueous composition having a solids content of 20%.

- 90 parts precipitated calcium carbonate (trademark: "CALCITE SA", secondary particle diameter: 3.0 μm/made by SHIRAISHI CALCIUM KAISHA, LTD.)
- 10 parts colloidal silica (trademark: "SYLOID", secondary particle diameter: 12 μm/made by FUJI DAVISON CHEMICAL LTD.)
- 46 parts amphoteric latex (trademark: "ACCOSTAR C122"/made by MITSUI CYANAMID, LTD.)
- 23 parts polyvinyl alcohol (trademark: "PVA-R-1130"/made by KURARAY CO., LTD.)
- 0.5 part dispersing agent (sodium polypyrophosphate)
- 0.03 part anti-foaming agent (trademark: "NOPCO 1407-K"/made by SAN NOPCO LIMITED)

Coating Composition 20

The following components were mixed with water and agitated so as to obtain an aqueous composition having a solids content of 15%.

- 90 parts precipitated calcium carbonate (trademark: "CALCITE SA", secondary particle diameter: 3.0 μm/made by SHIRAISHI CALCIUM KAISHA, LTD.)

10 parts colloidal silica (trademark: "SYLOID", secondary particle diameter: 12 μm/made by FUJI DAVISON CHEMICAL LTD.)

23 parts amphoteric latex (trademark: "ACCOSTAR C122"/made by MITSUI CYANAMID, LTD.)

46 parts polyvinyl alcohol (trademark: "PVA-R-1130"/made by KURARAY CO., LTD.)

0.5 part dispersing agent (sodium polypyrophosphate)

0.03 part anti-foaming agent (trademark: "NOPCO 1407-K"/made by SAN NOPCO LIMITED)

Preparation of Ink Jet Recording Paper

An ink jet recording paper was obtained as follows: The coating composition 19 was applied to a substrate of a synthetic paper having a thickness of 80 nm (trademark: "YUPO FPG-80"/made by OJI-YUKA SYNTHETIC PAPER CO., LTD.) by means of a bar coater so that the coating weight was 8 g/m$^2$ (solid matter), and the paper was dried, said coating composition 19 forming a bottom ink receptive layer. Then, time coating composition 20 was applied onto said bottom ink receptive layer by means of a bar coater so that the coating weight was 10 g/m$^2$ (solid matter), and the paper was dried, said coating composition 20 forming a top ink receptive layer.

EXAMPLE 20

Preparation of Aqueous Composition

Coating Composition 21

The following components were mixed with water and agitated so as to obtain an aqueous composition having a solids content of 20%.

90 parts precipitated calcium carbonate (trademark: "CALCITE SA", secondary particle diameter: 3.0 μm/made by SHIRAISHI CALCIUM KAISHA, LTD.)

10 parts colloidal silica (trademark: "SYLOID", secondary particle diameter: 12 μm/made by FUJI DAVISON CHEMICAL LTD.)

46 parts amphoteric latex (trademark: "ACCOSTAR C122"/made by MITSUI CYANAMID, LTD.)

23 parts polyvinylpyrrolidone (trademark: "LUVISKOL K-90", molecular weight: 360,000/made by BASF)

0.5 part dispersing agent (sodium polypyrophosphate)

0.03 part anti-foaming agent (trademark: "NOPCO 1407-K"/made by SAN NOPCO LIMITED)

Coating Composition 22

The following components were mixed with water and agitated so as to obtain an aqueous composition having a solids content of 20%.

90 parts precipitated calcium carbonate (trademark: "CALCITE SA", secondary particle diameter: 3.0 μm/made by SHIRAISHI CALCIUM KAISHA, LTD.)

10 parts colloidal silica (trademark: "SYLOID", secondary particle diameter: 12 μm/made by FUJI DAVISON CHEMICAL LTD.)

23 parts amphoteric latex (trademark: "ACCOSTAR C122"/made by MITSUI CYANAMID, LTD.)

46 parts polyvinylpyrrolidone (trademark: "LUVISKOL K-90", molecular weight: 360,000/made by BASF)

0.5 part dispersing agent (sodium polypyrophosphate)

0.03 part anti-foaming agent (trademark: "NOPCO 1407-K"/made by SAN NOPCO LIMITED)

Preparation of Ink Jet Recording Paper

An ink jet recording paper was obtained as follows: The coating composition 21 was applied to the same substrate as in Example 19 by means of a bar coater so that the coating weight was 8 g/m$^2$ (solid matter), and the paper was dried, said coating composition 21 forming a bottom ink receptive layer. Then, the coating composition 22 was applied onto said bottom ink receptive layer by means of a bar coater so that the coating weight was 10 g/m$^2$ (solid matter), and the paper was dried, said coating composition 8 forming a top ink receptive layer.

EXAMPLE 21

Preparation of Aqueous Composition

Coating Composition 23

The following components were mixed with water and agitated so as to obtain an aqueous composition having a solids content of 20%.

90 parts precipitated calcium carbonate (trademark: "CALCITE SA", secondary particle diameter: 3.0 μm/made by SHIRAISHI CALCIUM KAISHA, LTD.)

10 parts colloidal silica (trademark: "SYLOID", secondary particle diameter: 12 μm/made by FUJI DAVISON CHEMICAL LTD.)

46 parts amphoteric latex (trademark: "ACCOSTAR C122"/made by MITSUI CYANAMID, LTD.)

23 parts polyvinylpyrrolidone (trademark: "LUVISKOL K-90", molecular weight: 360,000/made by BASF)

20 parts cationic polymer (trademark: "SUMIREZ RESIN 1001"/made by SUMITOMO CHEMICAL CO., LTD.)

0.5 part dispersing agent (sodium polypyrophosphate)

0.03 part anti-foaming agent (trademark: "NOPCO 1407-K"/made by SAN NOPCO LIMITED)

Coating Composition 24

The following components were mixed with water and agitated so as to obtain an aqueous composition having a solids content of 20%.

90 parts precipitated calcium carbonate (trademark: "CALCITE SA", secondary particle diameter: 3.0 μm/made by SHIRAISHI CALCIUM KAISHA, LTD.)

10 parts colloidal silica (trademark: "SYLOID", secondary particle diameter: 12 μm/made by FUJI DAVISON CHEMICAL LTD.)

23 parts amphoteric latex (trademark: "ACCOSTAR C122"/made by MITSUI CYANAMID, LTD.)

46 parts polyvinylpyrrolidone (trademark: "LUVISKOL K-90", molecular weight: 360,000/made by BASF)

20 parts cationic polymer (trademark: "SUMIREZ RESIN 1001"/made by SUMITOMO CHEMICAL CO., LTD.)

0.5 part dispersing agent (sodium polypyrophosphate)

0.03 part anti-foaming agent (trademark: "NOPCO 1407-K"/made by SAN NOPCO LIMITED)

Preparation of Ink Jet Recording Paper

An ink jet recording paper was obtained as follows: The coating composition 23 was applied to the same substrate as in Example 19 by means of a bar coater so that the coating weight was 8 g/m$^2$ (solid matter), and the paper was dried, said coating composition 23 forming a bottom ink receptive layer. Then, the coating composition 24 was applied onto said bottom ink receptive layer by means or a bar coater so that the coating weight was 10 g/m$^2$ (solid matter), and the paper was dried, said coating composition 24 forming a top ink receptive layer.

EXAMPLE 22

Preparation of Aqueous Composition

Coating Composition 25

The following components were mixed with water and agitated so as to obtain an aqueous composition having a solids content of 20%.

- 50 parts fine-grained alumina (trademark: "ALUMINA A", secondary particle diameter: 4.8 μm/made by MIZUSAWA INDUSTRIAL CHEMICALS LTD. JAPAN)
- 50 parts colloidal silica (trademark: "SYLOID", secondary particle diameter: 12 μm/made by FUJI DAVISON CHEMICAL LTD.)
- 46 parts amphoteric latex (trademark: "ACCOSTAR C122"/made by MITSUI CYANAMID, LTD.)
- 23 parts polyvinylpyrrolidone (trademark: "LUVISKOL K-90", molecular weight: 360,000/made by BASF)
- 10 parts cationic polymer (trademark: "SUMIREZ RESIN 1001"/made by SUMITOMO CHEMICAL CO., LTD.)
- 20 parts cationic polymer (trademark: "KSR-100K"/made by SANYO CHEMICAL INDUSTRIES, LTD.)
- 0.5 part dispersing agent (sodium polypyrophosphate)
- 0.03 part anti-foaming agent (trademark: "NOPCO 1407-K"/made by SAN NOPCO LIMITED)

Coating Composition 26

The following components were mixed with water and agitated so as to obtain an aqueous composition having a solids content of 20%.

- 50 parts fine-grained alumina (trademark: "ALUMINA A", secondary particle diameter: 4.8 μm/made by MIZUSAWA INDUSTRIAL CHEMICALS LTD. JAPAN)
- 50 parts colloidal silica (trademark: "SYLOID", secondary particle diameter: 12 μm/made by FUJI DAVISON CHEMICAL LTD.)
- 23 parts amphoteric latex (trademark: "ACCOSTAR C122"/made by MITSUI CYANAMID, LTD.)
- 46 parts polyvinylpyrrolidone (trademark: "LUVISKOL K-90", molecular weight: 360,000/made by BASF)
- 10 parts cationic polymer (trademark: "SUMIREZ RESIN 1001"/made by SUMITOMO CHEMICAL CO., LTD.)
- 20 parts cationic polymer (trademark: "KSR-100K"/made by SANYO CHEMICAL INDUSTRIES, LTD.)
- 0.5 part dispersing agent (sodium polypyrophosphate)
- 0.03 part anti-foaming agent (trademark: "NOPCO 1407-K"/made by SAN NOPCO LIMITED)

Preparation of Ink Jet Recording Paper

An ink jet recording paper was obtained as follows: The coating composition 25 was applied to the same substrate as in Example 19 by means of a bar coater so that the coating weight was 8 g/m$^2$ (solid matter), and time paper was dried, said coating composition 25 forming a bottom ink receptive layer. Then, the coating composition 26 was applied onto said bottom ink receptive layer by means of a bar coater so that time coating weight was 10 g/m$^2$ (solid matter), and the paper was dried, said coating composition 26 forming a top ink receptive layer.

EXAMPLE 23

Preparation of Aqueous Composition

Coating Composition 27

The following components were mixed with water and agitated so as to obtain an aqueous composition having a solids content of 20%.

- 90 parts fine-grained silica (trademark: "FINESIL", secondary particle diameter: 3.7 μm, specific surface area by BET method: 280 m/g/made by TOKUYAMA SODA CO., LTD.)
- 1.0 parts colloidal silica (trademark: "SYLOID", secondary particle diameter: 12 μm/made by FUJI DAVISON CHEMICAL LTD.)
- 46 parts amphoteric latex (trademark: "ACCOSTAR C122"/made by MITSUI CYANAMID, LTD.)
- 23 parts polyvinylpyrrolidone (trademark: "LUVISKOL K-90", molecular weight: 360,000/made by BASF)
- 10 parts cationic polymer (trademark: "SUMIREZ RESIN 1001"/made by SUMITOMO CHEMICAL CO., LTD.)
- 20 parts cationic polymer (trademark: "KSR-100K"/made by SANYO CHEMICAL INDUSTRIES, LTD.)
- 0.5 part dispersing agent (sodium polypyrophosphate)
- 0.03 part anti-foaming agent (trademark: "NOPCO 1407-K"/made by SAN NOPCO LIMITED)

Coating Composition 28

The following components were mixed with water and agitated so as to obtain an aqueous composition having a solids content of 20%.

- 90 parts fine-grained silica (trademark: "FINESIL", secondary particle diameter: 3.7 μm, specific surface area by BET method: 280 m$^2$/g/made by TOKUYAMA SODA CO., LTD.)
- 10 parts colloidal silica (trademark: "SYLOID", secondary particle diameter: 12 μm/made by FUJI DAVISON CHEMICAL LTD.)
- 23 parts amphoteric latex (trademark: "ACCOSTAR C122"/made by MITSUI CYANAMID, LTD.)
- 46 parts polyvinylpyrrolidone (trademark: "LUVISKOL K-90", molecular weight: 360,000/made by BASF)
- 10 parts cationic polymer (trademark: "SUMIREZ RESIN 1001"/made by SUMITOMO CHEMICAL CO., LTD.)

20 parts cationic polymer (trademark: "KSR-100K"/made by SANYO CHEMICAL INDUSTRIES, LTD.)

0.5 part dispersing agent (sodium polypyrophosphate)

0.03 part anti-foaming agent (trademark: "NOPCO 1407-K"/made by SAN NOPCO LIMITED)

Preparation of Ink Jet Recording Paper

An ink jet recording paper was obtained as follows: The coating composition 27 was applied to the same substrate as in Example 19 by means of a bar coater so that the coating weight was 8 g/m$^2$ (solid matter), and time paper was dried, said coating composition 27 forming a bottom ink receptive layer. Then, the coating composition 28 was applied onto said bottom ink receptive layer by means of a bar coater so that the coating weight was 10 g/m$^2$ (solid matter), and the paper was dried, said coating composition 28 forming a top ink receptive layer.

EXAMPLE 24

Preparation of Aqueous Composition

Coating Composition 29

The following components were mixed with water and agitated so as to obtain an aqueous composition having a solids content of 20%.

50 parts precipitated calcium carbonate (trademark: "CALCITE SA", secondary particle diameter: 3.0 μm/made by SHIRAISHI CALCIUM KAISHA, LTD.)

50 parts fine-grained silica (trademark: "FINESIL", secondary particle diameter: 3.7 μm, specific surface area by BET method: 280 m$^2$/g/made by TOKUYAMA SODA CO., LTD.)

46 parts amphoteric latex (trademark: "ACCOSTAR C122"/made by MITSUI CYANAMID, LTD.)

23 parts polyvinylpyrrolidone (trademark: "LUVISKOL K-90", molecular weight: 360,000/made by BASF)

10 parts cationic polymer (trademark: "SUMIREZ RESIN 1001"/made by SUMITOMO CHEMICAL CO., LTD.)

20 parts cationic polymer (trademark: "KSR-100K"/made by SANYO CHEMICAL INDUSTRIES, LTD.)

0.5 part dispersing agent (sodium polypyrophosphate)

0.03 part anti-foaming agent (trademark: "NOPCO 1407-K"/made by SAN NOPCO LIMITED)

Coating Composition 30

The following components were mixed with water and agitated so as to obtain an aqueous composition having a solids content of 20%.

70 parts fine-grained silica (trademark: "FINESIL", secondary particle diameter: 3.7 μm, specific surface area by BET method: 280 m/g/made by TOKUYAMA SODA CO., LTD.)

30 parts colloidal silica (trademark: "SYLOID", secondary particle diameter: 12 μm/made by FUJI DAVISON CHEMICAL LTD.)

23 parts amphoteric latex (trademark: "ACCOSTAR C122"/made by MITSUI CYANAMID, LTD.)

46 parts polyvinylpyrrolidone (trademark: "LUVISKOL K-90", molecular weight: 360,000/made by BASF)

10 parts cationic polymer (trademark: "SUMIREZ RESIN 1001"/made by SUMITOMO CHEMICAL CO., LTD.)

20 parts cationic polymer (trademark: "KSR-100K"/made by SANYO CHEMICAL INDUSTRIES, LTD.)

0.5 part dispersing agent (sodium polypyrophosphate)

0.03 part anti-foaming agent (trademark: "NOPCO 1407-K"/made by SAN NOPCO LIMITED)

Preparation of Ink Jet Recording Paper

An ink jet recording paper was obtained as follows: The coating composition 29 was applied to the same substrate as in Example 19 by means of a bar coater so that the coating weight was 8 g/m$^2$ (solid matter), and the paper was dried, said coating composition 29 forming a bottom ink receptive layer. Then, the coating composition 30 was applied onto said bottom ink receptive layer by means of a bar coater so that the coating weight was 10 g/m$^2$ (solid matter), and the paper was dried, said coating composition 30 forming a top ink receptive layer.

EXAMPLE 25

An ink jet recording paper was obtained in the same way as in Example 23 except that in the coating composition 28 the amount of said amphoteric latex was changed from 23 parts to 35 parts and the amount of said polyvinylpyrrolidone was changed from 46 parts to 35 parts.

EXAMPLE 26

An ink jet recording paper was obtained in the same way as in Example 23 except that in the coating composition 28 the amount of said amphoteric latex was changed from 23 parts to 10 parts and the amount of said polyvinylpyrrolidone was changed from 46 parts to 50 parts.

EXAMPLE 27

An ink jet recording paper was obtained in the same way as in Example 23 except that in the coating composition 27 the amount of said amphoteric latex was changed from 46 parts to 60 parts and the amount of said polyvinylpyrrolidone was changed from 23 parts to 10 parts.

EXAMPLE 28

An ink jet recording paper was obtained in the same way as in Example 23 except that in the coating composition 27 time amount of said amphoteric latex was changed from 46 parts to 40 parts and the amount of said polyvinylpyrrolidone was changed from 23 parts to 30 parts.

COMPARATIVE EXAMPLE 1

An acidic wood free paper (trademark: "KANEOU", 81.4 g/m$^2$/made by NIPPON PAPER INDUSTRIES) was used as an ink jet recording paper.

COMPARATIVE EXAMPLE 2

A neutralized wood free paper (trademark: "KANEBISHI", 64.0 g/ms/made by MITSUBISHI PAPER MILLS LIMITED) was used as an ink jet recording paper.

COMPARATIVE EXAMPLE 3

A coated paper prepared as in the following was used as an ink jet recording paper.

A coating composition was prepared which contained pigments and binders, said pigments comprising 70 parts kaolin, 20 parts ground calcium carbonate and 10 parts satin white, said binders comprising 3 parts (solid matter) starch phosphate (ester) and 11 parts (solid matter) SBR latex. This coating composition was applied to both sides of a base paper having a basis weight of 50 g/m$^2$ so that the coating weight, dry basis, was 25 g/m$^2$ per side.

COMPARATIVE EXAMPLE 4

A synthetic paper on the market (trademark: "YUPO FPG-80" made by OJI-YUKA SYNTHETIC PAPER CO., LTD.) was used as an ink jet recording paper.

COMPARATIVE EXAMPLE 5

An ink jet recording paper was obtained in the same way as in Example 5 except that said amphoteric latex in the coating composition 5 used in Example 5 was replaced by an aqueous polyurethane resin (trademark: "HYDRAN AP-40"/made by DAINIPPON INK AND CHEMICALS, INC.).

COMPARATIVE EXAMPLE 6

An ink jet recording paper was obtained in the same way as in Example 17 except that said amphoteric latex in the coating composition 11 used in Example 17 was replaced by an aqueous vinyl acetate-ethylene copolymer (trademark: "SUMIKA FLEX 752" made by SUMITOMO CHEMICAL CO., LTD.)

COMPARATIVE EXAMPLE 7

An ink jet recording paper was obtained in the same way as in Example 17 except that in time coating composition 17 used in Example 17 the amount of said amphoteric latex was changed from 46 parts to 0 part and the amount of said polyvinylpyrrolidone was changed from 23 parts to 40 parts.

COMPARATIVE EXAMPLE 8

An ink jet recording paper was obtained in the same way as in Example 23 except that in the coating compositions 27 and 28 used in Example 23 the amount of said amphoteric latex was respectively changed to 0 part.

The ink jet recording papers thus obtained were subjected to evaluation tests as in the following, the results of which are shown in Table 2. In the evaluation tests, a printer made by Sharp Corporation (trademark: "IO-735X") and a printer made by Canon Inc. (trademark: "PIXEL-JET") were used. Both of these printers printed images on the recording papers by using four colors which were black, yellow, cyan and magenta. The methods and standards of evaluation were as follows:

Ink Absorption Time

After printing, time recording papers were left alone at a room temperature. For each of recording papers, an ink drying time (in second) was measured and shown in Table 2, said ink drying time being a period between the time of printing and the time when the ink of the printed image was dried to such an extent that the ink was not transferred to a finger touching the printed image. In Table 2, "QD" stands for "quick dry" which means that the ink was dried immediately after printing to such an extent that the ink was not transferred to a finger touching the printed image. In Table 2, "X" means that time ink dryig time was above 180 seconds.

Surface Strength

An adhesive tapewas applied to time ink receptive layer so that the adhesive tape closely contacts the ink receptive layer. Then, the adhesive tape was removed by hand from the ink receptive layer at an angle of 90°. The degree of the transfer of the ink receptive layer to the adhesive tape was visually evaluated, the results of which are shown in Table 2 by the following relative valuations:

◎: The ink receptive layer was not transferred.

○: The ink receptive layer was slightly transferred.

Δ: The ink receptive layer was partly transferred, but there was no problem in practice.

×: The ink receptive layer was much transferred.

Bleeding and Thinning of Recorded Image

The bleeding and thinning of the recorded image were visually evaluated, the results of which are shown in Table 2 by the following relative valuations:

◎: No bleeding or thinning was found.

○: Slight bleeding or thinning was found.

Δ: Some bleeding or thinning was found, but there was no problem in practice.

×: Much bleeding or thinning was found.

Note: "Thinning" means that the recorded image does not maintain its desired size. For example, the recorded image becomes thin, narrow or indistinct, tapers off, or is partly missing.

Color Reproduction of Recorded Image

The color and brightness of the recorded image were visually evaluated, the results of which are shown in Table 2 by the following relative valuations:

◎: Color and color reproduction were bright and excellent.

○: Color and color reproduction were slightly dim.

Δ: Color and color reproduction were rather poor, but there was no problem in practice.

×: Color and color reproduction were poor. (Recorded image was whitened because latex was whitened.)

Water resistance of Ink Receptive Layer

Water was given to the ink receptive layer, and wiped off with a certain finger pressure. The peeling off of the ink receptive layer was evaluated, the results of which are shown in Table 2 by the following relative valuations:

◎: Ink receptive layer was not peeled off.

○: Ink receptive layer was slightly peeled off.

Δ: Ink receptive layer was partly peeled off, but there was no problem in practice.

×: Ink receptive layer was much peeled off.

Water resistance of Recorded Image

The paper was printed by means of a printer and dipped in water for 30 minutes. Then, the paper was dried at a room temperature. The bleeding of the recorded image and the change of the color reproduction were visually evaluated, the results of which are shown in Table 2 by the following relative valuations:

◎: Recorded image was not changed.

○: Recorded image was slightly discolored.

Δ: Recorded image was rather discolored, but there was no problem in practice.

×: Recorded image was much discolored.

Total Evaluation

In view of the above evaluations, total evaluation was made, the results of which are shown in Table 2 by the following relative valuations:

◎: Excellent

○: Good

Δ: Rather poor, but no problem in practice.

×: Poor

As apparent from Table 2, the ink jet recording papers obtained in the examples of the present invention had excellent ink absorption and ensured sharp and bright recorded image. Furthermore, as compared with conventional recording papers comprising a substrate such as a synthetic film, the ink jet recording papers obtained in the examples of the present invention was excellent in the surface strength and water resistance of the ink receptive layer.

TABLE 1

| Properties of Ampho-Ion Latex | |
|---|---|
| External appearance | Milk white |
| Composition | Synthetic latex of core shell construction |
| Ions | Ampho-ions having<br>cation: quaternary alkylamine group<br>anion: carboxyl group |
| pH | 7 |
| Effective component | 40% |
| Viscosity | 500 cps |

TABLE 1-continued

| Properties of Ampho-Ion Latex | |
|---|---|
| Colloid equivalent value | +0.31 meq/g |
| Particle diameter | about 0.2 μm |
| MFT | 9° C. |
| Mechanical stability | No condensation was found after agitation for 30 minutes under a Maron tester load of 15 kg. |

TABLE 2

| | Ink Absorption (second) | Surface Strength | Bleeding & of Recorded Image | Color Reproduction of Recorded Image | Water Resistance of Receptive Layer | Water Resistance of Recorded Image | Total Evaluation |
|---|---|---|---|---|---|---|---|
| Example 1 | 60/40 | ◎/◎ | Δ/Δ | Δ/Δ | Δ/Δ | Δ/Δ | Δ |
| Example 2 | 60/60 | ◎/◎ | Δ/Δ | Δ/Δ | Δ/Δ | Δ/Δ | Δ |
| Example 3 | 60/40 | ◎/◎ | Δ/Δ | Δ/Δ | Δ/Δ | Δ/Δ | Δ |
| Example 4 | 50/30 | ◎/◎ | Δ/Δ | Δ/Δ | ○/○ | Δ/Δ | Δ |
| Example 5 | 50/30 | ◎/◎ | Δ/Δ | ○/○ | ○/○ | Δ/Δ | ○~Δ |
| Example 6 | 50/30 | ◎/◎ | Δ/Δ | ○/○ | ○/○ | Δ/Δ | ○~Δ |
| Example 7 | 40/30 | ◎/◎ | ○/○ | ○/○ | Δ/Δ | Δ/Δ | ○~Δ |
| Example 8 | 40/30 | ◎/◎ | ○/○ | ○/○ | Δ/Δ | Δ/Δ | ○~Δ |
| Example 9 | 40/30 | ◎/◎ | ○/○ | ○/○ | Δ/Δ | Δ/Δ | ○~Δ |
| Example 10 | 30/15 | ◎/◎ | ○/○ | ○/○ | ○/○ | Δ/Δ | ○ |
| Example 11 | 30/15 | ◎/◎ | ○/○ | ○/○ | ○/○ | Δ/Δ | ○ |
| Example 12 | 30/15 | ◎/◎ | ○/○ | ○/○ | ○/○ | Δ/Δ | ○ |
| Example 13 | 40/30 | ◎/◎ | ○/○ | ○/○ | ○/○ | ○/○ | ○ |
| Example 14 | 40/30 | ◎/◎ | ○/○ | ○/○ | ○/○ | ○/○ | ○ |
| Example 15 | 40/30 | ◎/◎ | ○/○ | ○/○ | ○/○ | ○/○ | ○ |
| Example 16 | 30/15 | ◎/◎ | ○/○ | ○/○ | ○/○ | ○/○ | ○ |
| Example 17 | 30/15 | ◎/◎ | ○/○ | ○/○ | ○/○ | ○/○ | ○ |
| Example 18 | 30/15 | ◎/◎ | ○/○ | ○/○ | ○/○ | ○/○ | ○ |
| Example 19 | QD/QD | ◎/◎ | ○/○ | ○/○ | Δ/Δ | Δ/Δ | ○~Δ |
| Example 20 | QD/QD | ◎/◎ | ○/○ | ○/○ | ○/○ | Δ/Δ | ○ |
| Example 21 | QD/QD | ◎/◎ | ○/○ | ○/○ | ○/○ | ○/○ | ○ |
| Example 22 | 20/20 | ◎/◎ | ○/○ | Δ/Δ | ○/○ | ○/○ | ○ |
| Example 23 | QD/QD | ◎/◎ | ◎/◎ | ◎/◎ | ◎/◎ | ◎/◎ | ◎ |
| Example 24 | QD/QD | ◎/◎ | ◎/◎ | ◎/◎ | ◎/◎ | ◎/◎ | ◎ |
| Example 25 | QD/QD | ◎/◎ | ◎/◎ | ◎/◎ | ◎/◎ | ◎/◎ | ◎ |
| Example 26 | QD/QD | ◎/◎ | ◎/◎ | ◎/◎ | ◎/◎ | ◎/◎ | ◎ |
| Example 27 | 10/10 | ◎/◎ | ○/○ | ○/○ | ◎/◎ | ◎/◎ | ◎~○ |
| Example 28 | QD/QD | ◎/◎ | ◎/◎ | ◎/◎ | ◎/◎ | ◎/◎ | ◎ |
| Comp. Example 1 | QD/QD | —/— | X/X | X/X | —/— | X/X | X |
| Comp. Example 2 | QD/QD | —/— | X/X | X/X | —/— | X/X | X |
| Comp. Example 3 | X/X | ○/○ | X/X | X/X | X/X | X/X | X |
| Comp. Example 4 | X/X | —/— | X/X | X/X | —/— | X/X | X |
| Comp. Example 5 | X/X | ◎/◎ | ○/○ | X/X | ○/○ | Δ/Δ | X |
| Comp. Fxample 6 | X/X | ◎/◎ | X/X | X/X | ○/○ | Δ/Δ | X |
| Comp. Example 7 | QD/QD | X/X | ◎/◎ | ○/○ | X/X | X/X | X |
| Comp. Example 8 | QD/QD | X/X | ◎/◎ | ○/○ | X/X | X/X | X |

(Note)
Printers used: "10-735X" made by Sharp Corporation and "PIXEL-JET" made by Canon Inc.

TABLE 3

| | Pigments | | | | Binders | | | | Cationic Polymers | | | |
|---|---|---|---|---|---|---|---|---|---|---|---|---|
| No. | CAL-CITE SA | ALUM-INA A | FINE-SIL | SY-LOID | ACCO-STAR C122 | PVA-R-1130 | PVPK-90 | S-752 | SR-1001 | KSR-100K | T.S. (%) | Coating Weight |
| Example 1 | 100 | | | | 46 | | | | | | 25 | 20 |
| Example 2 | 50 | 50 | | | 46 | | | | | | 25 | 20 |
| Example 3 | 50 | | | 50 | 46 | | | | | | 20 | 20 |
| Example 4 | | | | 100 | 46 | | | | | | 20 | 20 |
| Example 5 | | | 50 | 50 | 46 | | | | | | 10 | 20 |
| Example 6 | | | 90 | 10 | 50 | | | | | | 10 | 20 |
| Example 7 | 100 | | | | 46 | | 23 | | | | 20 | 20 |
| Example 8 | 50 | 50 | | | 46 | | 23 | | | | 20 | 20 |
| Example 9 | 50 | | | 50 | 46 | | 23 | | | | 18 | 20 |
| Example 10 | | | | 100 | 46 | | 23 | | | | 18 | 20 |
| Example 11 | | | 50 | 50 | 46 | | 23 | | | | 10 | 20 |
| Example 12 | | | 90 | 10 | 50 | | 25 | | | | 10 | 20 |
| Example 13 | 100 | | | | 46 | | 23 | | 10 | 20 | 20 | 20 |
| Example 14 | 50 | 50 | | | 46 | | 23 | | 10 | 20 | 20 | 20 |
| Example 15 | 50 | | | 50 | 46 | | 23 | | 10 | 20 | 20 | 20 |
| Example 16 | | | | 100 | 46 | | 23 | | 10 | 20 | 20 | 20 |
| Example 17 | | | 50 | 50 | 46 | | 23 | | 10 | 20 | 20 | 20 |
| Example 18 | | | 90 | 10 | 50 | | 25 | | 20 | | 20 | 20 |
| Example 19 | | | | | | | | | | | | |
| bottom | | 90 | | | 10 | 46 | 23 | | | | 20 | 8 |
| top | 90 | | | 10 | 23 | 46 | | | | | 15 | 10 |
| Example 20 | | | | | | | | | | | | |
| bottom | 90 | | | 10 | 46 | | 23 | | | | 20 | 8 |
| top | 90 | | | 10 | 23 | | 46 | | | | 20 | 10 |
| Example 21 | | | | | | | | | | | | |
| bottom | 90 | | | 10 | 46 | | 23 | | 20 | | 20 | 8 |
| top | 90 | | | 10 | 23 | | 46 | | 20 | | 20 | 10 |
| Example 22 | | | | | | | | | | | | |
| bottom | | 50 | | 50 | 46 | | 23 | | 10 | 20 | 20 | 8 |
| top | | 50 | | 50 | 23 | | 46 | | 10 | 20 | 20 | 10 |
| Example 23 | | | | | | | | | | | | |
| bottom | | | 90 | 10 | 46 | | 23 | | 10 | 20 | 20 | 8 |
| top | | | 90 | 10 | 23 | | 46 | | 10 | 20 | 20 | 10 |
| Example 24 | | | | | | | | | | | | |
| bottom | 50 | | 50 | | 46 | | 23 | | 10 | 20 | 20 | 8 |
| top | | | 70 | 30 | 23 | | 46 | | 10 | 20 | 20 | 10 |
| Example 25 | | | | | | | | | | | | |
| bottom | | | 90 | 10 | 46 | | 23 | | 10 | 20 | 20 | 8 |
| top | | | 90 | 10 | 35 | | 35 | | 10 | 20 | 20 | 10 |
| Example 26 | | | | | | | | | | | | |
| bottom | | | 90 | 10 | 46 | | 23 | | 10 | 20 | 20 | 8 |
| top | | | 90 | 10 | 10 | | 50 | | 10 | 20 | 20 | 10 |
| Example 27 | | | | | | | | | | | | |
| bottom | | | 90 | 10 | 60 | | 10 | | 10 | 20 | 20 | 8 |
| top | | | 90 | 10 | 23 | | 46 | | 10 | 20 | 20 | 10 |
| Example 28 | | | | | | | | | | | | |
| bottom | | | 90 | 10 | 40 | | 30 | | 10 | 20 | 20 | 8 |
| top | | | 90 | 10 | 23 | | 46 | | 10 | 20 | 20 | 10 |
| Comp. Example 1 | Acidic wood free paper "KANEOU"/ | | | | | | | | | | | |
| Comp. Example 2 | Neutralized wood free paper "KANEBISHI"/ | | | | | | | | | | | |
| Comp. Example 3 | Coated paper: kaolin + calcium carbonate | | | | | | | | | | | |
| Comp. Example 4 | YUPO FPG-80/ | | | | | | | | | | | |
| Comp. Example 5 | | | 50 | 50 | 46 parts HYDRAN AP-40 | | | | | | 10 | 20 |
| Comp. Example 6 | | | 50 | 50 | 46 parts SUMIKA FLEX 752 | | | | 10 | 20 | 20 | 20 |
| Comp. Example 7 | | | 50 | 50 | 40 parts PVP K-90 | | | | 10 | 20 | 20 | 20 |

TABLE 3-continued

| | Pigments | | | | Binders | | | | | | | |
|---|---|---|---|---|---|---|---|---|---|---|---|---|
| | CAL-CITE | ALUM-INA | FINE- | SY- | ACCO-STAR | PVA-R- | PVPK- | | Cationic Polymers | | | Coating |
| No. | SA | A | SIL | LOID | C122 | 1130 | 90 | S-752 | SR-1001 | KSR-100K | T.S. (%) | Weight |
| Comp. Example 8 | | | | | | | | | | | | |
| bottom | | | 90 | 10 | | | 23 | | 10 | 20 | 20 | 8 |
| top | | | 90 | 10 | | | 46 | | 10 | 20 | 20 | 10 |

What is claimed is:

1. An ink jet recording sheet comprising a substrate selected from the group consisting of plastic films and synthetic papers; and an ink receptive layer disposed on said substrate, said ink receptive layer consisting essentially of a pigment and a binder, the improvement comprising forming said ink receptive layer by the following steps:

a) applying to said substrate at least one aqueous composition consisting essentially of a pigment and an amphoteric latex formed by seed polymerization of a carboxylated synthetic rubber latex or synthetic resin emulsion with an alkylamine monomer, said amphoteric latex being present in a range of about 5 to 70 parts by weight per 100 parts by weight of said pigment; and b) drying.

2. An ink jet recording sheet comprising a substrate selected from the group consisting of plastic films and synthetic papers; and an ink receptive layer disposed on said substrate, said ink receptive layer consisting essentially of a pigment and a binder, the improvement comprising forming said ink receptive layer by the following steps:

a) applying to said substrate at least one aqueous composition consisting essentially of a pigment, a water-soluble high polymer, and an amphoteric latex formed by seed polymerization of a carboxylated synthetic rubber latex or synthetic resin emulsion with an alkylamine monomer, said amphoteric latex being present in a range of about 5 to 70 parts by weight per 100 parts by weight of said pigment; and, b) drying.

3. An ink jet recording sheet as claimed in claim 2, wherein said aqueous composition comprises 10 to 70 parts by weight of amphoteric latex and 5 to 70 parts by weight of water-soluble high polymer per 100 parts by weight of pigment.

4. An ink jet recording sheet as claimed in claim 3, wherein during the formation of said ink receptive layer two or more layers of said aqueous composition are used and the bottom or lowest layer included therein contains more amphoteric latex than the other layer or layers.

5. An ink jet recording sheet as claimed in claim 4, wherein said two or more layers of said aqueous composition comprise a top layer and a bottom layer, said top layer and said bottom layer respectively satisfying the following conditions:

Top layer: an aqueous composition comprising 10 to 35 parts by weight of amphoteric latex and 20 to 70 parts by weight of water-soluble high polymer per 100 parts by weight of pigment, the amount of said amphoteric latex being equal to or smaller than the amount of said water-soluble high polymer Bottom layer: an aqueous composition comprising 40 to 70 parts by weight of amphoteric latex and 5 to 30 parts by weight of water-soluble high polymer per 100 parts by weight of pigment

6. An ink jet recording sheet as claimed in claim 5, wherein said pigment of said ink receptive layer includes fine-grained silica.

7. An ink jet recording sheet as claimed in claim 6, wherein said water-soluble high polymer of said ink receptive layer is polyvinylpyrrolidone.

8. An ink jet recording sheet as claimed in claim 7, wherein said aqueous composition of said ink receptive layer further comprises a cationic polymer.

* * * * *